US005186094A

United States Patent [19]

Allart

[11] Patent Number: 5,186,094

[45] Date of Patent: Feb. 16, 1993

[54] PRESSURIZED FLUID MECHANISM COMPRISING AT LEAST TWO DISTINCT OPERATIONAL CYLINDER CAPACITIES

[75] Inventor: Bernard R. Allart, Crepy en Valois, France

[73] Assignee: Poclain Hydraulics, France

[21] Appl. No.: 900,737

[22] Filed: Jun. 17, 1992

[30] Foreign Application Priority Data

Jun. 25, 1991 [FR] France ..... 91 07820

[51] Int. Cl.[5] ..... F01B 13/06

[52] U.S. Cl. ..... 91/491

[58] Field of Search ..... 91/491, 498, 492, 497

[56] References Cited

U.S. PATENT DOCUMENTS

| | | | |
|---|---|---|---|
| Re. 32,446 | 6/1987 | Allart et al. | 91/491 |
| 3,296,937 | 1/1967 | Guinot | 91/498 X |
| 3,403,599 | 10/1968 | Guinot | 91/491 X |
| 3,593,621 | 7/1971 | Praddaude | 91/492 X |
| 3,808,951 | 5/1974 | Martin | 91/492 |
| 4,318,336 | 3/1982 | Bock | 91/498 X |
| 4,326,450 | 4/1982 | Bacquie | 91/491 X |
| 4,356,761 | 11/1982 | Cameron-Johnson | 91/491 X |
| 4,404,896 | 9/1983 | Allart et al. | 91/491 |
| 4,532,854 | 8/1985 | Foster | 91/492 X |
| 4,724,742 | 2/1988 | Bigo et al. | 91/491 |
| 4,807,519 | 2/1989 | Wusthof et al. | 91/497 X |

FOREIGN PATENT DOCUMENTS

| | | |
|---|---|---|
| 1460752 | 12/1966 | France . |
| 2481755 | 11/1981 | France . |
| 2588616 | 4/1987 | France . |
| 2606092 | 5/1988 | France . |

*Primary Examiner*—Leonard E. Smith
*Attorney, Agent, or Firm*—Ladas & Parry

[57] ABSTRACT

This invention relates to a fluid mechanism with two cylinder capacities, comprising a distributor valve defining first and second enclosures containing supply and exhaust fluids comprising two groups of distribution conduits, and a device for selecting the cylinder capacity, constituted by a bore and a slide element for selection. According to the invention, a first and a second connection conduit connect the first and second enclosures to the bore and open out between transverse planes; distribution conduits open out in the bore between these planes; and the slide element comprises a groove contained between said planes and establishing communication between the distribution conduits and the connection conduit. One application of the invention is the production of a compact motor.

11 Claims, 10 Drawing Sheets

1C
X
IX
29
27
18
124
25
122
32
20
31
34
158
121
33
144
154
195
142
143
153
P1
51
P2
R1
138
135
R2
156
138A
160
159
155
142
149
137
148
123
136
192
152
26
147
157
30
145
28
146
194
190
19
X
IX
17

1C
XIII
XII
29
27
18
25
31
158
121
33
32
34
159
154
195
143
153
144
51
156
P1
P2
142
135
138A
149
138
160
155
137
136
152
123
26
157
30
28
19
XIII
XII
17

PRESSURIZED FLUID MECHANISM COMPRISING AT LEAST TWO DISTINCT OPERATIONAL CYLINDER CAPACITIES

FIELD OF THE INVENTION

The present invention relates to a pressurized fluid mechanism, such as a hydraulic motor or pump, with at least two distinct operational cylinder capacities, comprising: a reaction cam; a structure fast with said reaction cam and supporting it; a cylinder-block mounted for relative rotation with respect to said structure about an axis of rotation and provided with a plane communication face perpendicular to the axis of rotation; a plurality of cylinders arranged in said cylinder-block; a plurality of pistons mounted to slide in said cylinders, at least one piston per cylinder defining inside said cylinder a fluid working chamber, which communicates with said communication face by a cylinder conduit; an internal fluid distributor valve which is fast, with respect to rotation of said reaction cam, which defines between itself and said structure at least first and second principal fluid enclosures capable of containing, respectively, a fluid for supplying said working chamber and a fluid for exhaust of fluid from the working chambers, and which comprises a plane distribution face perpendicular to said axis of rotation, capable of being in substantially tight abutment on said communication face, distribution face into which open out pairs of distribution conduits made in the internal fluid distributor valve and distributed in at least two distinct groups of pairs of distribution conduits; a device for selecting the cylinder capacity, which is constituted by a bore made in the internal fluid distributor and by a selection slide element mounted to move inside said bore, which is disposed on the distribution conduits of at least a first of said two groups of pairs of distribution conduits, the mobile slide element comprising at least two positions, a first position in which first distribution conduits, one of each pair, of said two groups of pairs of distribution conduits are connected to a first of said principal enclosures, the second distribution conduits of said pairs of distribution conduits then being connected to the second of the two principal enclosures, and the second position in which the first distribution conduits and the second distribution conduits of said first group of pairs of distribution conduits are placed in mutual communication, the first distribution conduits of the second group of pairs of distribution conduits being connected to said first principal enclosure and the second distribution conduits of said second group of pairs of distribution conduits being connected to said second principal enclosure.

In such pressurized fluid mechanisms, such as in particular certain hydraulic motors, three and even four enclosures must often be provided, which succeed one another axially along the bore of the device for selecting the cylinder capacity, which has for its effect to give the internal fluid distributor valve of these mechanisms relatively large axial dimensions, estimated excessive in certain cases.

The invention pursues the aim of reducing these axial dimensions of the internal fluid distributor valves of known pressurized fluid mechanisms.

SUMMARY OF THE INVENTION

To that end, according to the invention, the following arrangements are adopted: a1) at least one first and at least one second connection conduit, made in the internal fluid distributor valve, connect said first and second principal enclosures to said bore of the device for selecting the cylinder capacity and open out in this bore between planes belonging to a group of two first transverse planes and between planes belonging to a group of two second transverse planes, respectively; b1) particular distribution conduits, constituted by distribution conduits belonging to the first group of pairs of distribution conduits, open out in said bore between two particular transverse planes belonging either to the group of said two first particular transverse planes, or to the group of said two second transverse planes; c1) the mobile slide element of the device for selecting the cylinder capacity comprises at least one groove capable of being disposed at least partially between said two particular transverse planes; and d1) in the first position of the mobile slide element of the device for selecting the cylinder capacity, said groove is effectively contained at least partially between said two particular transverse planes and establishes communication between said particular distribution conduits and that of said first and second connection conduits which opens out between said two particular transverse planes, whilst, in its second position, said slide element obturates said connection conduit.

The following advantageous arrangements are, in addition, preferably adopted:

according to a first variant embodiment: b2) first and second particular distribution conduits are constituted by said first and by said second distribution conduits of the pairs of distribution conduits of the first group of pairs of distribution conduits and open out in said bore between the two first transverse planes and between the two second transverse planes, respectively; c2) the mobile slide element of the device for selecting the cylinder capacity comprises a first and a second groove capable of being simultaneously disposed at least partially between said two first and between the two second transverse planes, respectively; and d2) in the first position of the mobile slide element of the device for selecting the cylinder capacity, said first and second grooves are effectively contained at least partially between said two first and between said two second transverse planes, respectively, and establish communications, on the one hand, between said first particular distribution conduits and said first connection conduit, on the other hand, between said second particular distribution conduits and said second connection conduit, respectively, whilst, in its second position, the slide element obturates said first and second connection conduits;

the mobile slide element of the device for selecting the cylinder capacity is mounted to slide axially inside said bore, whilst being rendered fast with the internal fluid distributor valve with respect to a possible rotation about the axis of this bore, and comprises longitudinal communication grooves, which open out in one of said first and second grooves and which, in the second position of the mobile slide element, establish communication of said first and said second particular distribution conduits with said groove, and, by its intermediary, between said first and second particular distribution conduits themselves;

the slide element of the device for selecting the cylinder capacity is coupled to a jack for adjusting its position which comprises a working chamber, whilst, in the second position of said slide element, a conduit, made in the internal fluid distributor valve, connects said groove, into which open out said longitudinal communication grooves, to said working chamber;

according to a second variant embodiment: b3) particular distribution conduits are constituted either by said first or by said second distribution conduits of the first group of pairs of distribution conduits and open out in said bore between two particular transverse planes belonging to one of said groups of two first transverse planes and of two second transverse planes, respectively; c3) the mobile slide element of the device for selecting the cylinder capacity comprises a single groove capable of being disposed at least partially between said two particular transverse planes; d3) in the first position of the mobile slide element of the device for selecting the cylinder capacity, said groove is effectively contained at least partially between said two particular transverse planes and establishes communication between said particular distribution conduits and the connection conduit which opens out between said two particular transverse planes, whilst, in its second position, the slide element obturates said connection conduit;

in the second position of the mobile slide element of the device for selecting the cylinder capacity, said single groove is contained at least partially between said two transverse planes other than said two particular transverse planes, whilst the mobile slide element is mounted to slide axially inside said bore, whilst being rendered fast with the internal fluid distributor valve with respect to a possible rotation about the axis of this bore, and comprises longitudinal communication grooves which open out in said single groove and which, in the second position of the mobile slide element, establishes communication of said particular distribution conduits with said groove and, by its intermediary, of said particular distribution conduits with that of said first and second connection conduits which opens out between said transverse planes other than said two particular transverse planes;

generally, at least one of said connection conduits may be constituted by a conduit contained in the same radial plane as a distribution conduit of the second group of pairs of distribution conduits and constitutes an extension, up to the bore of the device for selecting the cylinder capacity, of a section of said distribution conduit;

in the embodiment according to the general definition and to the first variant, at least one of said connection conduits is constituted by a conduit contained in the same radial plane as a distribution conduit of the second group of pairs of distribution conduits and constitutes an extension, up to the bore of the device for selecting the cylinder capacity, of a section of said distribution conduit, whilst at least one distribution conduit belonging to the first group of distribution conduits, comprises a section which is disposed in a radial plane and which constitutes an extension, beyond said bore of the device for selecting the cylinder capacity, of said connection conduit.

The principal advantage of the invention resides in the fact that it now becomes possible to reduce the number of fluid enclosures which succeed one another axially along said bore, to two principal enclosures, the other enclosure(s) being arranged inside the fluid distributor valve.

BRIEF DESCRIPTION OF THE DRAWINGS

The invention will be more readily understood on reading the following description with reference to the accompanying drawings, in which.

DETAILED DESCRIPTION OF THE DRAWINGS

Figure 1:
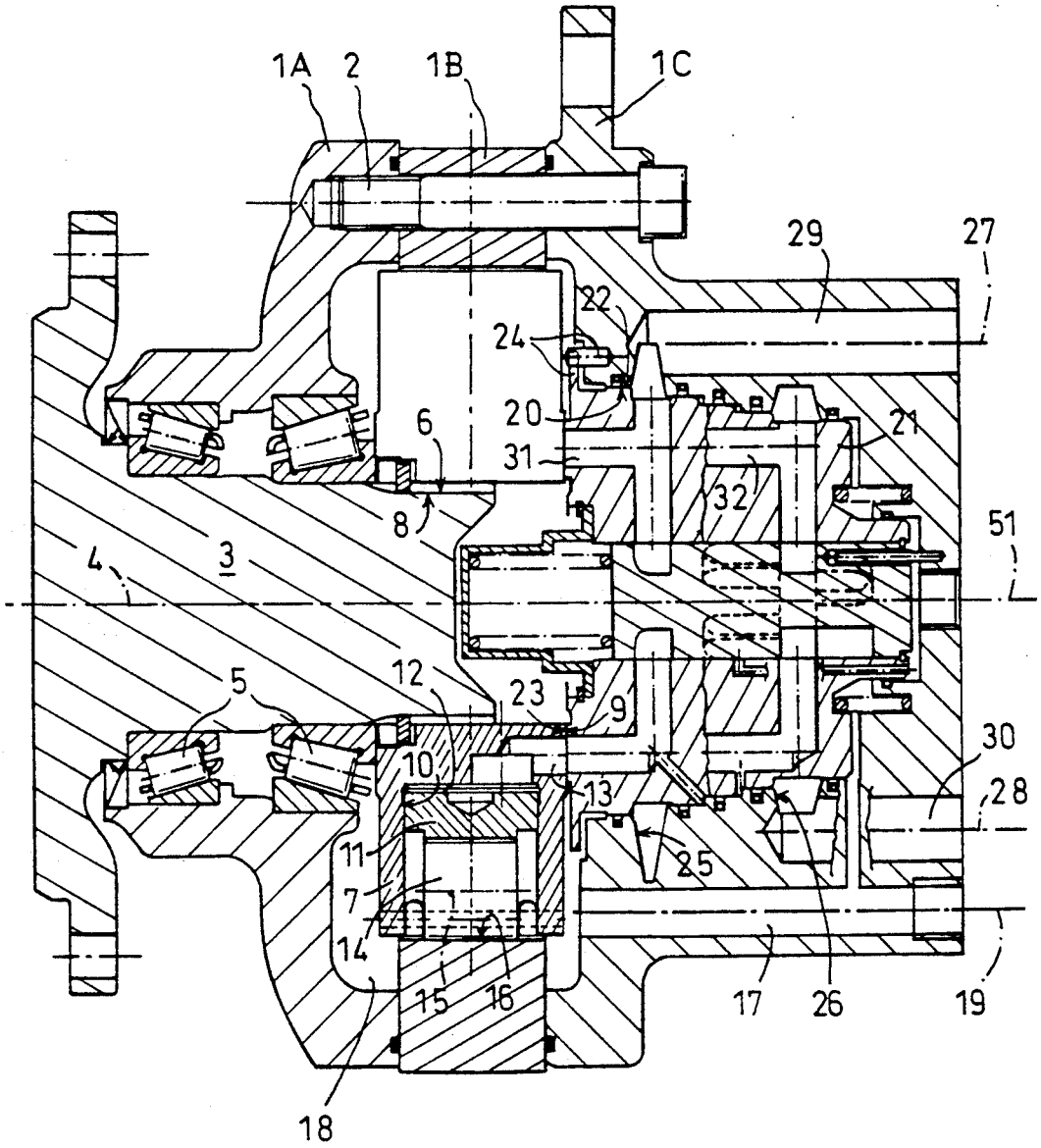
FIG. 1 is an axial section through a hydraulic motor in accordance with a first embodiment according to the invention, shown in a first operational configuration.
Figure 5:
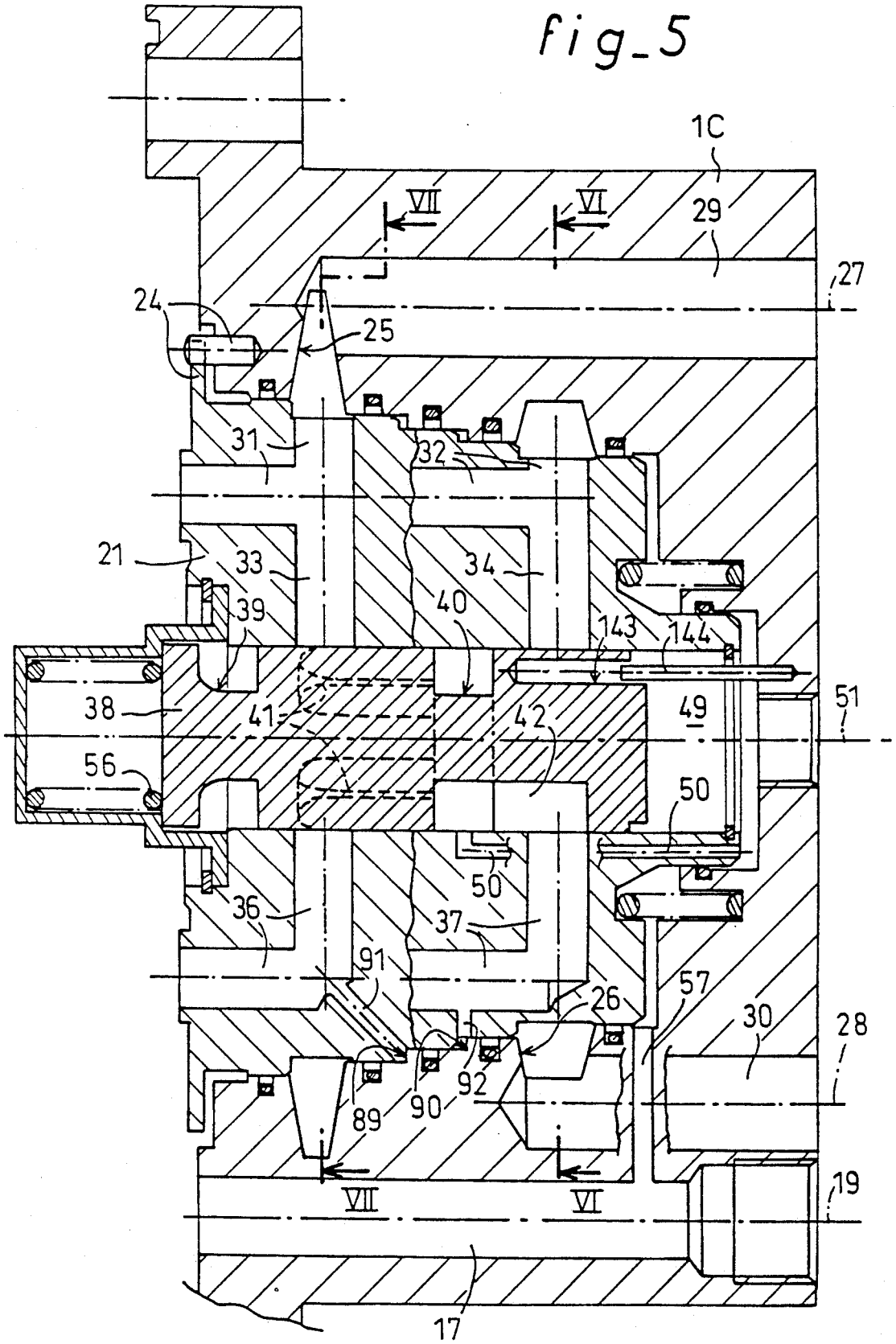
FIG. 5 is an axial section, similar to that of FIG. 2, of the same motor, but shown in a second operational configuration.
Figure 6:
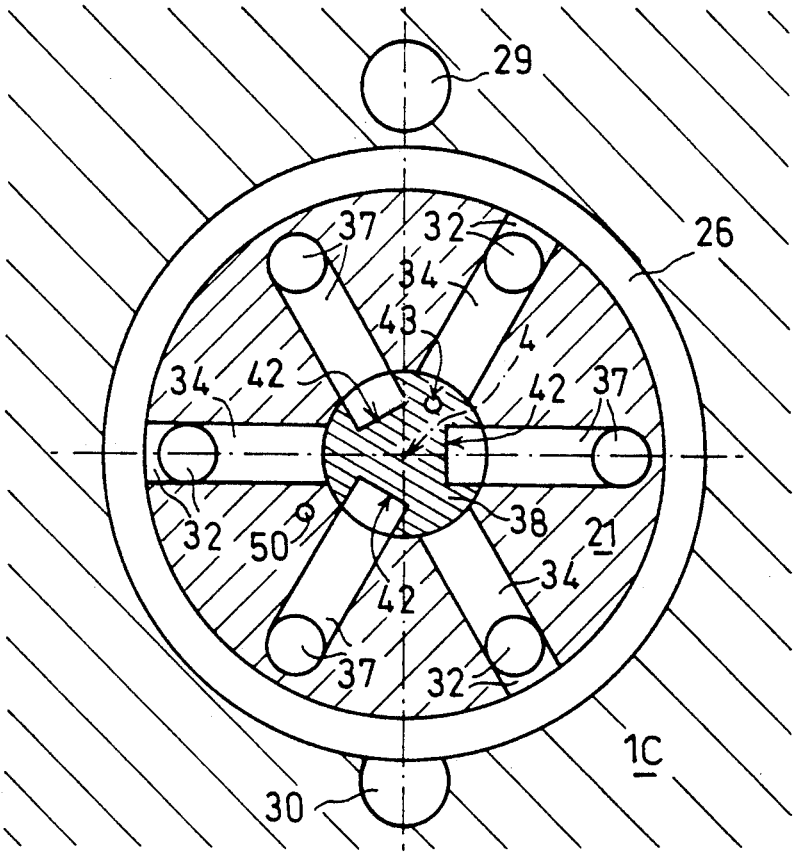
FIGS. 6 and 7 are transverse sections respectively along VI—VI and VII—VII of FIG. 5.
Figure 7:
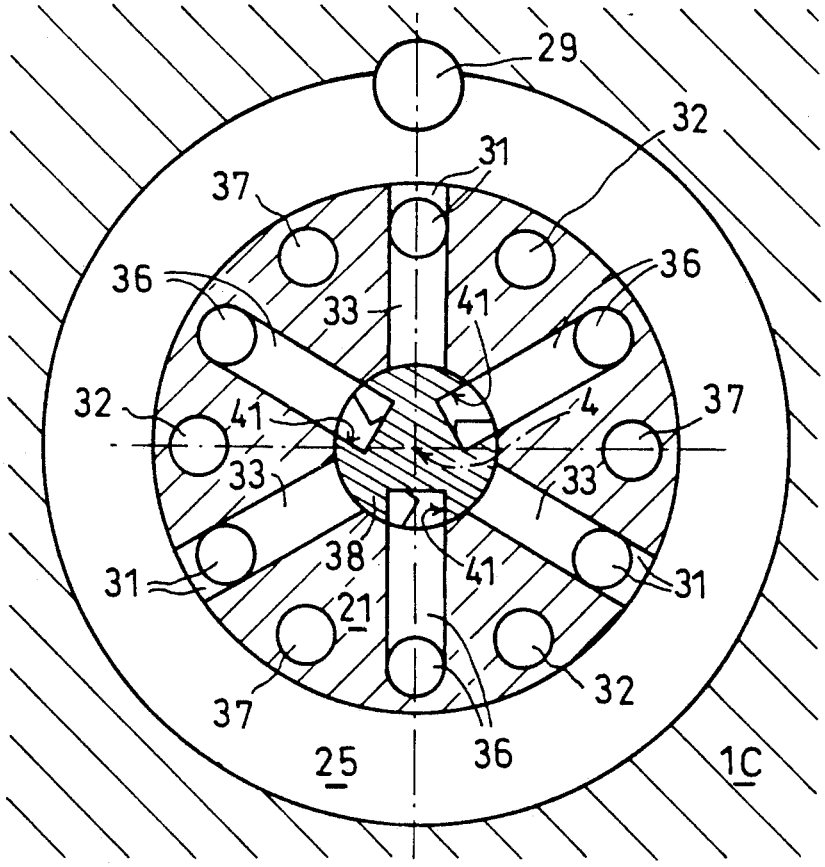

Referring now to the drawings, the hydraulic motor shown in FIGS. 1 to 7 comprises:

a housing in three parts 1A, 1B and 1C assembled by screws 2;

a drive shaft 3 mounted to rotate with respect to housing 1A—1B—1C, about an axis of rotation 4, by means of roller bearings 5, one end of which drive shaft is contained inside the housing and comprises splines 6;

a cylinder-block 7 presenting a central bore provided with splines 8, which cooperate with splines 6 to render fast said cylinder-block 7 with the drive shaft 3 with respect to rotation about axis of rotation 4, this cylinder-block comprising a plane communication face 9 perpendicular to the axis of rotation 4;

a plurality of cylinders 10 arranged in the cylinder-block 7, disposed radially with respect to the axis of rotation 4 and regularly spaced angularly;

a plurality of pistons 11 received in the cylinders 10, one per cylinder, mounted to slide inside the cylinder 10 and defining inside this cylinder a fluid working chamber 12 which communicates with the plane communication face 9 by a cylinder conduit 13;

rollers 14 each mounted at the outer end of a piston 11 for rotation with respect to said piston about an axis 15 parallel to the axis of rotation 4, and in abutment on the inner face of the intermediate part 1B of the housing, which constitutes a lobed reaction cam 16;

a conduit 17, made in part 1C of the housing, connects the enclosure 18 defined by said housing to an outer conduit 19;

said part 1C of the housing comprises a central recess 20 of revolution whose axis of revolution merges with the axis of rotation 4;

an internal fluid distributor valve 21, of which one axial peripheral face 22 presents a shape substantially complementary of that of the recess 20 and of which a plane distribution face 23, perpendicular to the axis of rotation 4, is in substantially tight abutment on the communication face 9, a device 24 incorporating associated notches and lugs rendering the internal fluid distributor valve 21 fast, with respect to the rotation of the axis of rotation 4, with part 1C of the housing;

two principal enclosures 25, 26 are formed between the internal fluid distributor valve 21 and the recess 20, and communicate with outer conduits 27, 28 via conduits 29, 30 formed in part 1C of the housing, respectively;

a group of distribution conduits 31, 32, formed in the internal fluid distributor valve 21 and corresponding, per pair of conduits 31-32, to the lobes of a group of lobes of the reaction cam 16, communicate, distribution conduits 31, with the principal enclosure 25, and, distribution conduits 32, with the principal enclosure 26, and open out in the distribution face 23 so as, during relative rotation of the cylinder-block 7 with respect to the housing 1A—1B—1C, and consequently with respect to the internal fluid distributor valve 21, to communicate periodically with the cylinder conduits 13;

connection conduits 33, 34, formed in the internal fluid distributor valve 21, connect at least one of the distribution conduits 31, 32 and, by their intermediary, the principal enclosures 25, 26, to a bore 35 made in the internal fluid distributor valve 21, in which said connection conduits open out, connection conduits 33 between two transverse planes P1, P2, perpendicular to axis 4, and connection conduits 34 between two transverse planes R1, R2, perpendicular to axis 4;

another group of distribution conduits 36, 37, made in the internal fluid distributor valve 21 and corresponding, per pair of distribution conduits 36-37, to the lobes of another group of lobes of the reaction cam 16, communicate, distribution conduits 36 with bore 35, opening out therein between the transverse planes P1, P2, and distribution conduits 37, with bore 35, opening out therein between the transverse planes R1, R2, said distribution conduits 36, 37 opening out, in addition, in the distribution face 23 so as, during relative rotation of the cylinder-block 7 with respect to the housing 1A—1B—1C, to communicate periodically with the cylinder conduits 13;

a slide element 38, mounted to slide tightly inside the bore 35, comprises: two grooves 39, 40 axially spaced apart so that, in one of the positions of the slide element 38 inside the bore 35 (FIGS. 1 and 2), the groove 39 is included in planes P1, P2, and groove 40 is included between planes R1, R2 of the blind axial conduits 41, 42 which extend on either side of the groove 40 and permanently communicate therewith and with the bore 35; and an axial seat 43 for receiving a freely sliding indexation stud 44 in rotation with respect to part 1C of the housing, fixed on part 1C of the housing;

two intermediate grooves 89, 90, disposed between the recess 20 of part 1C of the housing and the axial face 22 of the internal fluid distributor valve 21, located between the principal enclosures 25, 26, these principal enclosures 25, 26 constituting grooves for admission of a pressurized fluid and for exhaust of fluid, and grooves 89, 90 permanently communicating, by means of conduits 91, 92, made in the internal fluid distributor valve 21, respectively with the distribution conduits 36, 37 of said other group of distribution conduits, said principal enclosures 25, 26 and grooves 89, 90, having shapes making it possible permanently to balance the thrusts due to the pressures of the fluids contained in the distribution conduits 31, 32, 36, 37, which communicate with these principal enclosures and these grooves, said thrusts being exerted on the internal fluid distributor valve 21;

O-rings 45, 46, 93, 94, 47 and 48 are interposed between the internal fluid distributor valve 21 and the recess 20 of part 1C of the housing, and isolate:

O-ring 45, the principal enclosure 25 from enclosure 18;

O-ring 46, the principal enclosure 25 from groove 89,

O-ring 93, groove 89 from groove 90,

O-ring 94, groove 90 from the principal enclosure 26,

O-ring 47, a chamber 52 defined between the internal fluid distributor valve 21 and part 1C of the housing and communicating with conduit 17 via a conduit 57 made in part 1C of the housing, from groove 90, and O-ring 48, chamber 52 from a control chamber 49, made between part 1C of the housing, between the latter, the end of the internal fluid distributor valve 21 opposite the distribution face 23 and one end of the slide element 38;

a discharge conduit 50, formed in the internal fluid distributor valve 21, opens out, on the one hand, in bore 35, on the other hand, in chamber 49;

an internal reaction stop 53 is fixed on the central part of the internal fluid distributor valve 21 by a segment 54 received in a groove 55 of said internal fluid distributor valve, ensures hold of a spring 56 which is interposed between itself and the slide element 38 and whose effect, antagonistic to that of the pressure of the fluid contained in chamber 49, tends to place slide element 38 in a first position (FIGS. 1 and 2) in which conduits 33 and 36 communicate with groove 39, conduits 34 and 37 communicate with groove 40, conduits 41, 42 communicate only with groove 40, and conduit 50 is obturated by slide element 38;

an outer conduit 51 is connected to chamber 49 and is capable of conveying a pressurized fluid adapted to place the slide element 38 in a second position (FIG. 5), in which, on the one hand, groove 40 is obturated by bore 35, but communicates with blind conduits 41, 42, on the other hand, conduit 50 opens out in this groove 40, the connection conduits 33 and 34 being obturated by the slide element 38 (FIGS. 5, 6 and 7);

a spring 58, contained in chamber 52, is interposed between the internal fluid distributor valve 21 and part 1C of the housing and tends to place the distribution face 23 in substantially tight abutment on the communication face 9 of the cylinder-block 7;

a segment 59, received in a groove 60 made in the bore 35 of the internal distributor valve 21, constitutes a stop for limiting the slide of slide element 38, which, when it is in abutment on this segment 59, is disposed in its first position.

The following particular features should also be observed:

one single connection conduit 33 would have sufficed to ensure, in the first position of slide element 38 (FIGS. 1 to 4), communication of the distribution conduits 36 with the principal enclosure 25: in the motor shown, the number of connection conduits 33 is equal to that of the distribution conduits 31, which contributes to reducing the pressure drops and to ensuring a satisfactory supply of the distribution conduits 36;

the same applies concerning the number of connection conduits 34 and distribution conduits 32 and 37;

the connection conduits 33 are in fact aligned, each radially with a radial section of a distribution conduit 31 and with a radial section of a distribution conduit 36 (FIGS. 2 and 4), which makes it possible to machine by a single radial drilling of the internal fluid distributor valve 21 the assembly of a connection conduit 33 and of said radial sections of a distribution conduit 31 and a distribution conduit 36;

the same applies concerning the radial alignment of each connection conduit 34 with a radial section of a distribution conduit 32 and with a radial section of a distribution conduit 37;

finally, if, in the embodiment shown, grooves 39, 40 are contained in planes P1-P2, R1-R2 respectively, in the first position of slide element 38, it would suffice that there be at least partial register establishing communication of these grooves 39, 40 with conduits 33, 34, respectively.

Figure 2:
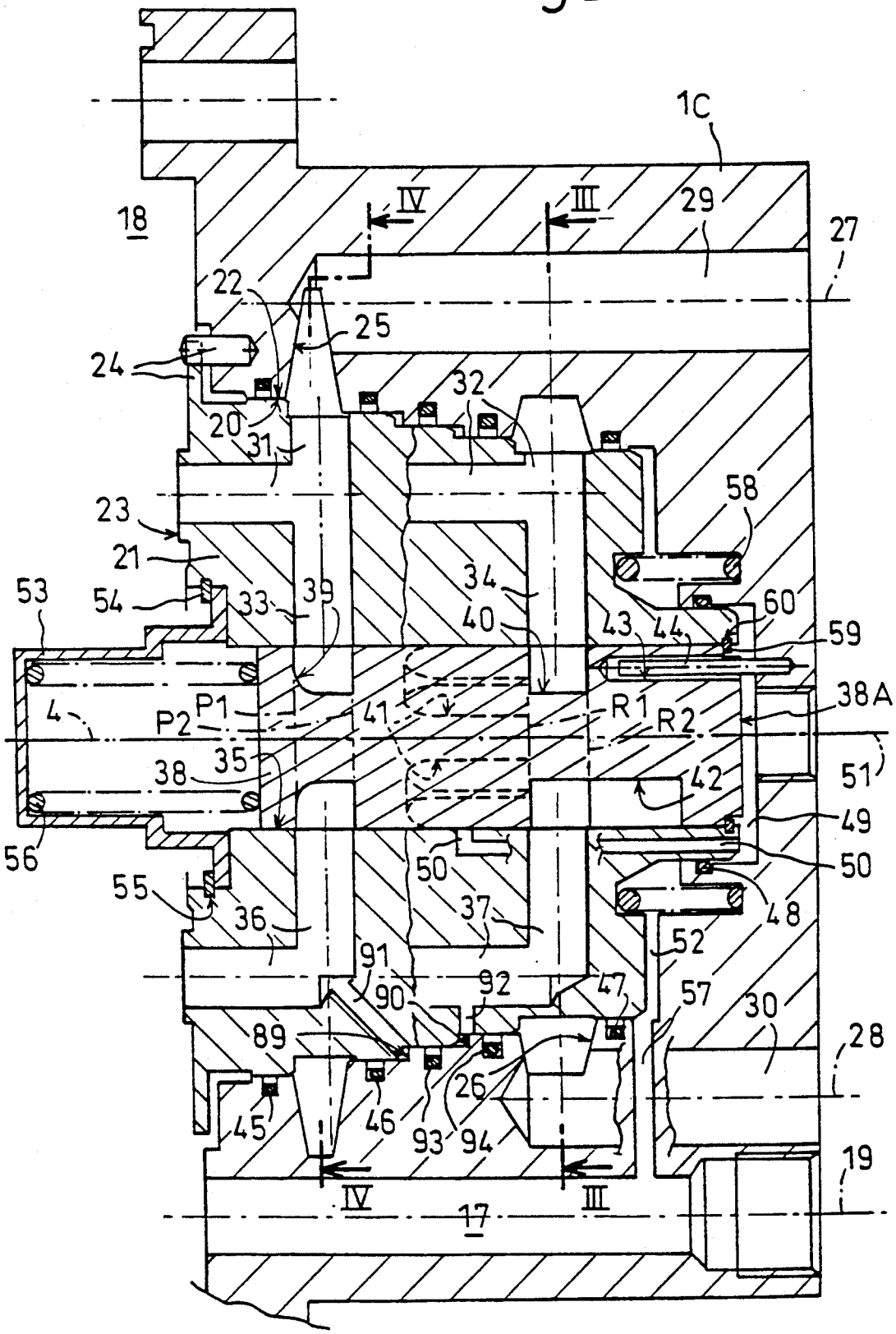
FIG. 2 is an enlargement of the parts of FIG. 1 more particularly relative to the invention.
Figure 14:
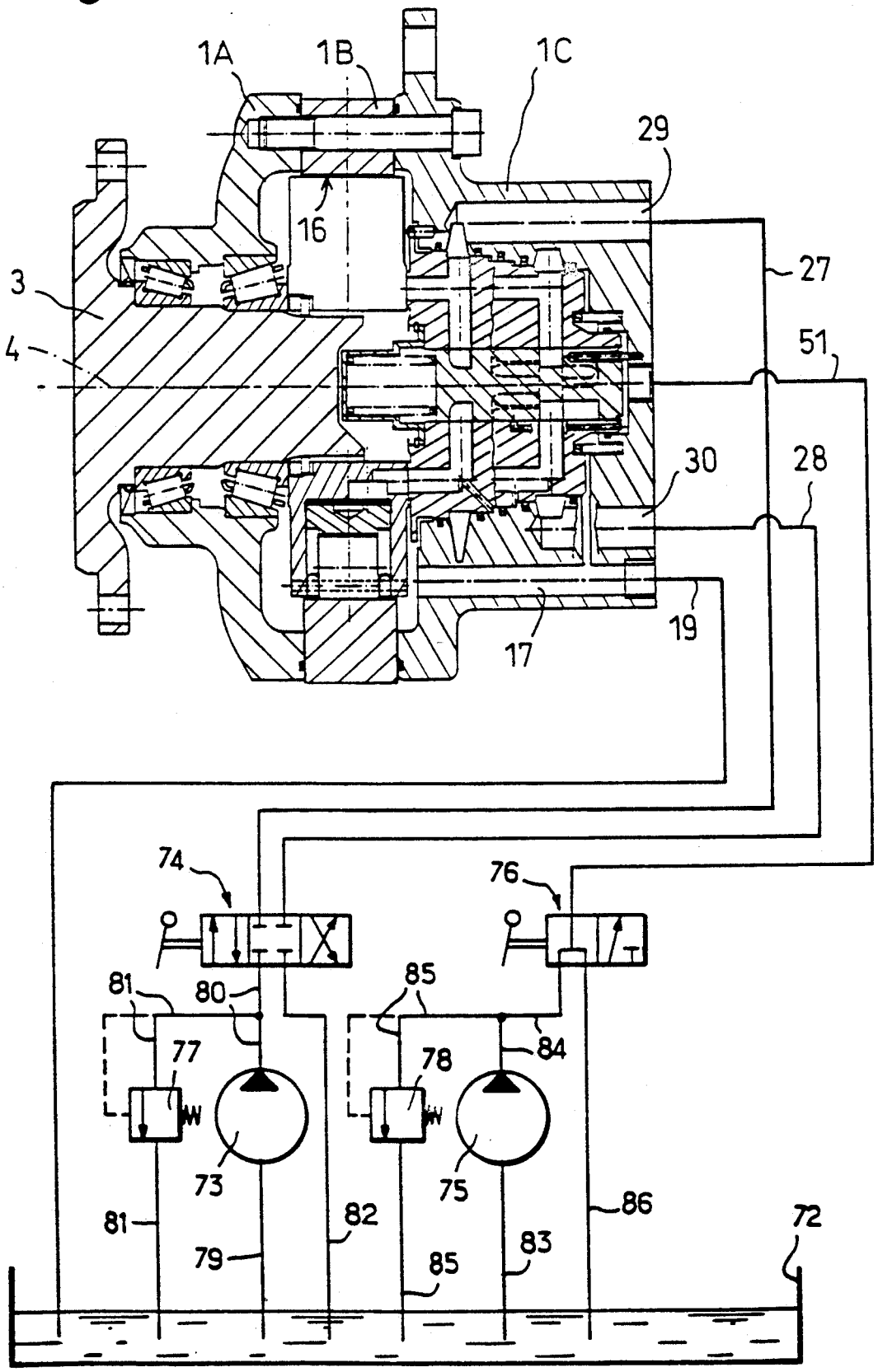
FIG. 14 shows a hydraulic circuit for supply and control of the motor of FIGS. 1 to 7.

The hydraulic circuit of FIG. 14 includes the whole of the hydraulic motor which has just been described, in its configuration shown in FIGS. 1 and 2, and comprises:

said motor;

a reservoir 72 for pressure-less fluid;

a principal pump 73;

a three-way, principal fluid distributor valve 74;

a secondary pump 75;

a two-way, secondary fluid distributor valve 76;

two discharge valves 77 and 78 for protection against over-pressures; and the following conduits:

suction conduit 79 of the principal pump 73, connecting the latter to reservoir 72;

delivery conduit 80 of the principal pump 73, connecting the latter to the principal fluid distributor 74;

a conduit 81, which connects the delivery conduit 80 to reservoir 72 and on which is placed the discharge valve 77;

a conduit 82 connecting the principal fluid distributor valve 74 to reservoir 72;

the suction conduit 83 of the secondary pump 75, connecting the latter to tank 72;

the delivery conduit 84 of the secondary pump 75, connecting the latter to the secondary fluid distributor valve 76;

a conduit 85, which connects the delivery conduit 84 to reservoir 72 and on which the discharge valve 78 is placed; and a conduit 86 connecting the secondary fluid distributor valve 76 to reservoir 72.

Connection of conduits 27 and 28 to the principal fluid distributor valve 74; connection of conduit 51 to the secondary fluid distributor valve 76, and connection of conduit 19 to reservoir 72 are to be noted.

The three positions of the principal fluid distributor valve 74 correspond as follows:

the first position, to the communication of conduits 80 and 27 and of conduits 28 and 82;

the second position, to the obturations of conduits 27, 28, 80 and 82; and the third position, to the communication of conduits 80 and 28 and of conduits 27 and 82.

The two positions of the secondary fluid distributor valve 76 correspond as follows:

the first position, to the communication of conduits 84, 51 and 86 and to the first configuration of the hydraulic motor and its slide element 38; and the second position, to the communication of conduits 84 and 51, to the obturation of conduit 86, and to the second configuration of the hydraulic motor and its slide element 38.

The hydraulic motor, of which only part has been shown in FIGS. 8 to 13, is identical to the one shown in FIGS. 1 to 7, except for the following characteristics: the internal fluid distributor valve 121 modifies and replaces the internal fluid distributor valve 21, in the same way as the sliding element 138, mounted to slide in a bore 135 presented by the internal fluid distributor valve 121, modifies and replaces the sliding element 38 of the embodiment of FIGS. 1 to 7. The modification between the two motors (FIGS. 1 to 7 and FIGS. 8 to 13) resides in the embodiment of the internal fluid distribution: in the embodiment of FIGS. 1 to 7, the internal fluid distribution is "symmetrical" and comprises, in the configuration of FIGS. 1 to 4, four distinct enclosures for distribution of the fluid (the two principal enclosures 25, 26 and the two grooves 39, 40 of the sliding element 38), whilst, in the embodiment of FIGS. 7 to 13, the internal fluid distribution is "asymmetrical" and comprises only three distinct enclosures for distribution of the fluid (the two principal enclosures 25, 26 and one groove 195 of sliding element 138).

The following description of the embodiment of FIGS. 8 to 13 employs the same references as those of the embodiment of FIGS. 1 to 7 concerning identical elements and adds the number 100 to the references of the modified elements.

Figure 11:
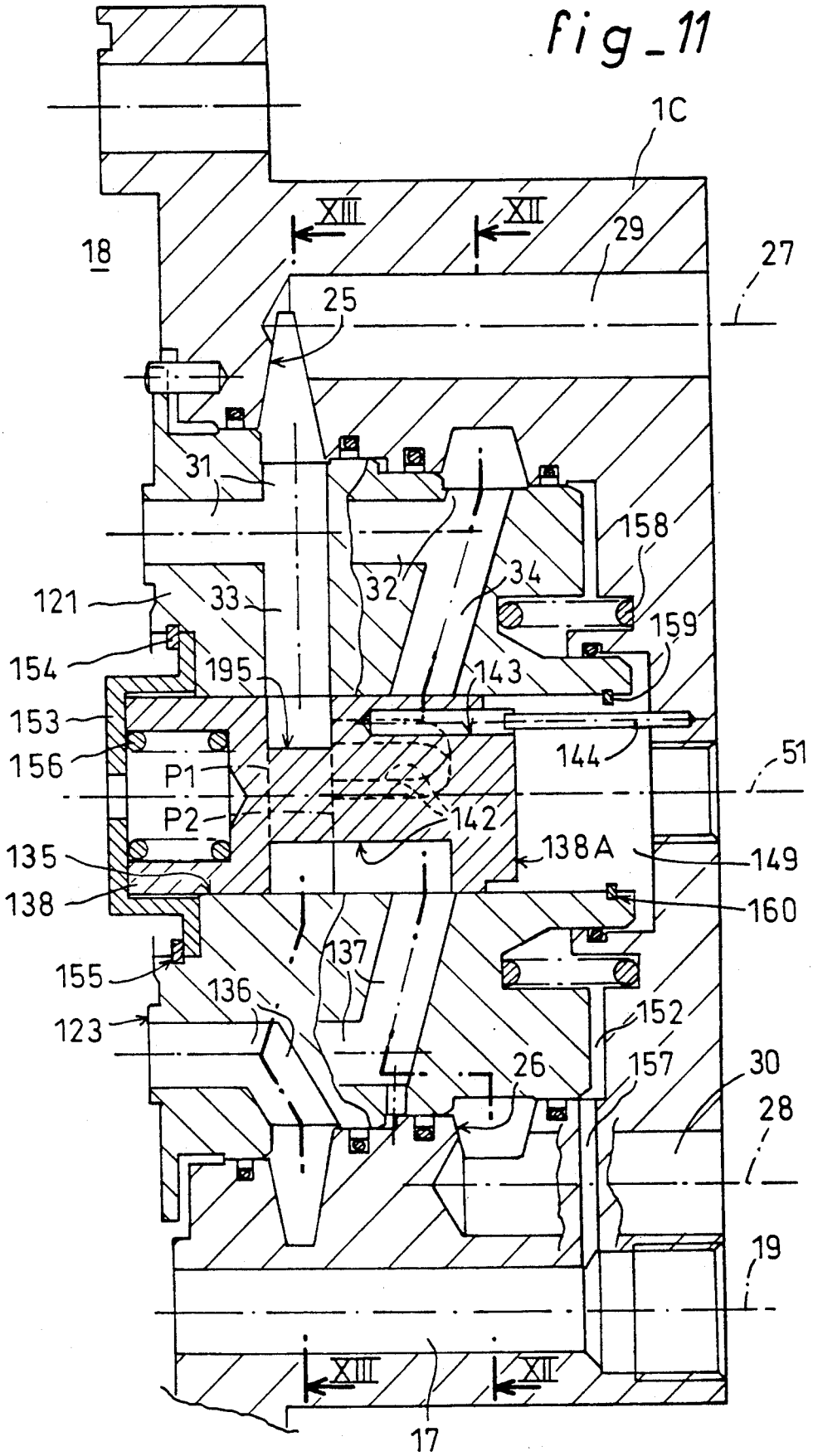
FIG. 11 is an axial section, similar to that of FIG. 8, of the same motor, but shown in a second operational configuration.
Figure 12:
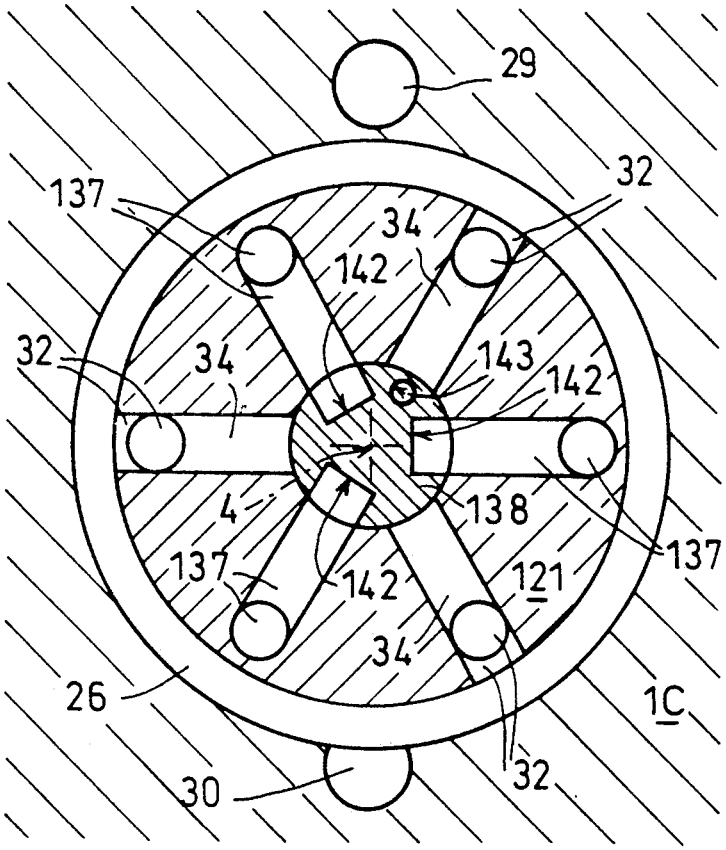
FIGS. 12 and 13 are sections respectively along XII—XII and XIII—XIII of FIG. 11.

The motor shown in FIGS. 8 to 13 presents the elements shown in FIG. 1 and further comprises:

an internal fluid distributor valve 121 of which one axial peripheral face 122 presents a shape substantially complementary of that of the recess 20 of part 1C of the housing and of which one plane distribution face 123, perpendicular to the axis of rotation 4, is in substantially tight abutment on the communication face of the cylinder-block 9, a device 124 incorporating associated notches and lugs rendering the internal fluid distributor valve 121 fast, with respect to rotation of axis of rotation 4, with part 1C of the housing;

two principal enclosures 25, 26 are arranged between the internal fluid distributor valve 121 and the recess 20, and communicate with outer conduits 27, 28 via conduits 29, 30 made in part 1C of the housing, respectively;

a group of distribution conduits 31, 32, made in the internal fluid distributor valve 121 and corresponding, per pair of conduits 31-32, to the lobes of a group of lobes of the reaction cam 16, communicate, distribution conduits 31, with the principal enclosure 25, and distribution conduits 32, with the principal enclosure 26, and open out in the distribution face 123 so as, in the course of relative rotation of the cylinder-block 7 with respect to housing 1A—1B—1C and consequently with respect to the internal fluid distributor valve 121, to communicate periodically with the cylinder conduits 13;

connection conduits 33, 34, made in the internal fluid distributor valve 121, connect at least one of the distribution conduits 31, 32 and, by their intermediary, the principal enclosures 25, 26, to a bore 135 made in the internal fluid distributor valve 121, in which said connection conduits open out, connection conduits 33 between two transverse planes P1, P2, perpendicular to axis 4, and connection conduits 34 between two transverse planes R1, R2, perpendicular to axis 4;

another group of distribution conduits 136, 137, made in the internal fluid distributor valve 121 and corresponding, per pair of distribution conduits 136-137, to the lobes of another group of lobes of the reaction cam 16, communicate, distribution conduits 136 directly with the principal enclosure 25 and distribution conduits 137 with bore 135, opening out therein between the transverse planes R1, R2, said distribution conduits 136, 137 opening out, in addition, in the distribution face 123 so as, in the course of relative rotation of the cylinder-block 7 with respect to housing 1A—1B—1C, to communicate periodically with the cylinder conduits 13;

a slide element 138, mounted to slide tightly inside bore 135, comprises: a single groove 195 disposed so that, in a first position of the slide element 138 (FIGS. 8 to 10), this groove 195 is included between planes R1, R2, slide element 138 then obturating the connection conduit or conduits 33 (FIGS. 8 and 10), and, in a second position of the slide element 138 (FIGS. 11 to 13), groove 195 is included between planes P1, P2, slide element 138 then obturating connection conduit or conduits 34 (FIGS. 11 and 12); blind axial conduits 142 which permanently communicate with groove 195 and with bore 135; and an axial housing 143 for receiving a freely sliding indexation stud 144 in rotation with respect to part 1C of the housing, fixed on part 1C of the housing;

an intermediate groove 190, disposed between recess 20 of part 1C of the housing and the axial face 122 of the internal fluid distributor valve 121, located between the principal enclosures 25, 26, these principal enclosures 25, 26 constituting grooves for admission of a pressurized fluid and for exhaust of fluid, and this groove 190 permanently communicating, by means of conduits 192, made in the internal fluid distributor valve 121, with the distribution conduits 37 of said other group of distribution conduits, said principal enclosures 25, 26 and groove 190, having shapes making it possible permanently to balance thrusts due to the pressures of the fluids contained in conduits 31, 32, 137, which communicate with these principal enclosures and these grooves, said thrusts being exerted on the internal fluid distributor valve 121;

O-rings 145, 146, 194, 147 and 148 are interposed between the internal fluid distributor valve 121 of recess 20 of part 1C of the housing, and isolate:

O-ring 145, the principal enclosure 25 from enclosure 18;

O-ring 146, the principal enclosure 25 from groove 190;

O-ring 194, groove 190 from principal enclusure 26;

O-ring 147, a chamber 152 defined between the internal fluid distributor valve 121 and part 1C of the housing and communicating with conduit 17 via a conduit 157 made in part 1C of the housing, from the principal enclosure 26, and O-ring 148, chamber 152 from a control chamber 149, made between part 1C of the housing, between the latter, the end of the internal fluid distributor valve 121 opposite the distribution face 123 and an end 138A of the slide element 138;

an internal reaction stop 153 is fixed on the central part of the internal fluid distributor valve 121 by a segment 154 received in a groove 155 of said internal fluid distributor valve, ensures hold of a spring 156, which is interposed between itself and the slide element 138 and whose effect, antagonistic to that of the pressure of the fluid contained in chamber 149, tends to place slide element 138 in its first position (FIGS. 8 to 10) in which the connection conduits 33 are obturated, conduits 34 and 137 communicate with groove 195, conduits 142 communicating only with groove 195;

an outer conduit 51 is connected to chamber 149 and is capable of conveying a pressurized fluid adapted to place slide element 138 in its second position (FIGS. 11 to 13), in which groove 195 is disposed between planes P1, P2, and communicates directly with conduits 33 and, via the blind conduits 142, with conduits 137, the connection conduits 34 being, furthermore, obturated by slide element 138 (FIGS. 11 and 12);

a spring 158, contained in chamber 152, is interposed between the internal fluid distributor valve 121 and part 1C of the housing, and tends to place the distribution face 123 in substantially tight abutment on the communication face 9 of the cylinder-block 7;

a segment 159, received in a groove 160 made in bore 135 of the internal fluid distributor valve 121, constitutes a stop for limiting the slide of slide element 138, which, when it is in abutment on this segment 159, is disposed in its first position.

It should be observed that, if one single connection conduit 33 suffices, in the second position of the slide element 138 (FIGS. 11 and 13) to ensure communication of the principal enclosure 25 with groove 195 of slide element 138, the fact that there are as many connection conduits 33 as distribution conduits 31 contributes to minimizing the pressure drops and to allowing a satisfactory communication between the principal enclosure 25 and the distribution conduits 137 (via the blind conduits 142). The same applies concerning the equality of the numbers of connection conduits 34 and of said distribution conduits 137 (FIGS. 11 and 12). In addition, similarly to what has been noted concerning the first embodiment described (FIGS. 1 to 7), if, in the embodiment of FIGS. 8 to 13, groove 195 of the slide element, in the first position thereof, is completely contained between planes R1-R2, it would suffice that it be so at least partially, so as to communicate with the distribution conduits 34.

The hydraulic circuit of FIG. 14 is applied without modification to the motor shown in FIGS. 8 to 13.

Furthermore, as may be seen from the following description of the functioning of the hydraulic motors shown, on the one hand with reference to FIGS. 1 to 7, on the other hand, with reference to FIGS. 8 to 13, each of these motors comprises a device for selecting the cylinder capacity which makes the choice of the cams opposite which the working chambers 12 communicate successively with a source of pressurized fluid and with a pressure-less exhaust, and that of other possible cams opposite which the working chambers 12 are isolated from at least one of these enclosures, the distribution conduits 36, 37 or 136, 137 being, in the examples shown, placed in mutual communication. This type of selection of the cylinder capacity is known under the name of "selection of the cylinder capacity by the cams", or other type of selection of the cylinder capacity existing, not envisaged here, effecting the regrouping of the cylinders, of which certain, for a determined selection, are permanently isolated from one of said enclosures: in that case, it is question of "selection of the cylinder capacity by the cylinders".

Functioning of the hydraulic motor shown in FIGS. 1 to 7 and 14 will now be set forth.

Figure 3:
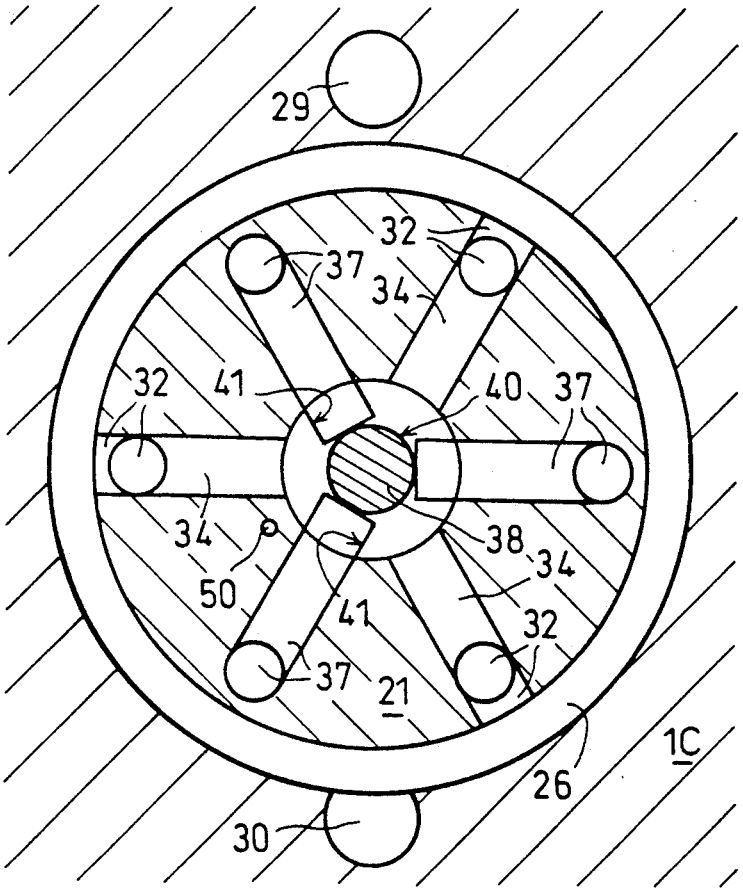
FIGS. 3 and 4 are transverse sections respectively along III—III and IV—IV of FIG. 2.
Figure 4:
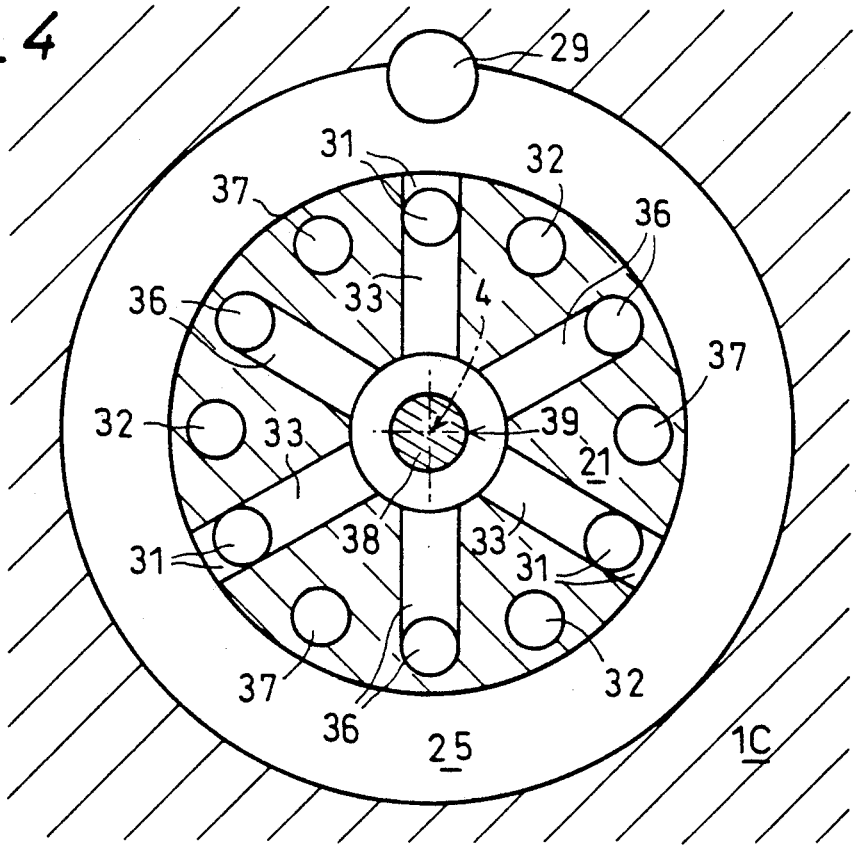

The fluid distributor valves 74 and 76 each being placed in their first position, the motor is placed in its first configuration shown in FIGS. 2 to 4. The pressurized fluid delivered by the principal pump 73 is admitted in conduit 29 and in the principal enclosure 25, and fills distribution conduits 31 and 36. The fluid, after having worked in the working chambers 12 of the motor, returns to reservoir 72 via distribution conduits 32, 37, principal enclosure 26, and conduits 28 and 82. Distribution conduits 31 of the two groups of distribution conduits 36 are all supplied with pressurized fluid delivered by the principal pump 73: the motor functions with its large cylinder capacity.

The principal fluid distributor valve 74 being placed in its first position, but the secondary fluid distributor valve 76 being placed in its second position, slide element 38 is also placed in its second position, and the motor is placed in its second configuration (FIGS. 5 to 7). The pressurized fluid delivered by the principal pump 73 is admitted in conduit 29 and in enclosure 25 and fills only distribution conduits 31, the connection conduits 33 being obturated by slide element 38. The fluid, which worked in the working chambers 12, escapes from the motor via distribution conduits 32, principal enclosure 26, conduit 30 and conduits 28 and 82, and returns to reservoir 72. The motor functions with its small cylinder capacity, which corresponds to the supply of distribution conduits 31 only. It should be observed that the distribution conduits 36 and 37, placed in mutual communication by the blind conduits 41 and 42, and by groove 40, communicate in addition, via conduit 50, with chamber 49. They are therefore filled with the fluid delivered by the secondary pump 75, which is the fluid for adjusting the position of slide element 38, generally at low pressure (5 to 10 bars), contrarily to the fluid delivered by the principal pump 73, at high pressure (350 to 400 bars).

An important characteristic resides in the fact that, axially, the dimensions are small for a motor with two operational cylinder capacities: this is obtained by the choice of the combined locations of the orifices by which the distribution conduits 36 and the connection conduits 33 opening out in the bore 35, between the two planes P1, P2, and by the choice of the similar locations concerning the orifices of the distribution conduits 37 and the connection conduits 34. In brief, instead of having four axially offset enclosures, as is already known, the novel motor presents dimensions corresponding to only two enclosures: those corresponding to conduits 33, 34 included between planes P1, P2 and R1, R2, respectively and those corresponding to conduits 36, 37, likewise included between the same planes P1, P2 and R1, R2, respectively.

On the contrary, it is not necessary to place the orifices of conduits 33 and 36, or 34 and 37 in the same transverse rows as the principal enclosures 25 and 26, respectively. The embodiment of FIGS. 8 to 13 shows conduits 34 and 137 which extend obliquely with respect to a transverse plane perpendicular to axis 4. However, in this embodiment, the advantage of axial compactness is found, associated with the fact that the orifices by which the connection conduits 34 and the distribution conduits 137 open out in bore 135, are contained between the two planes R1, R2.

Figure 8:
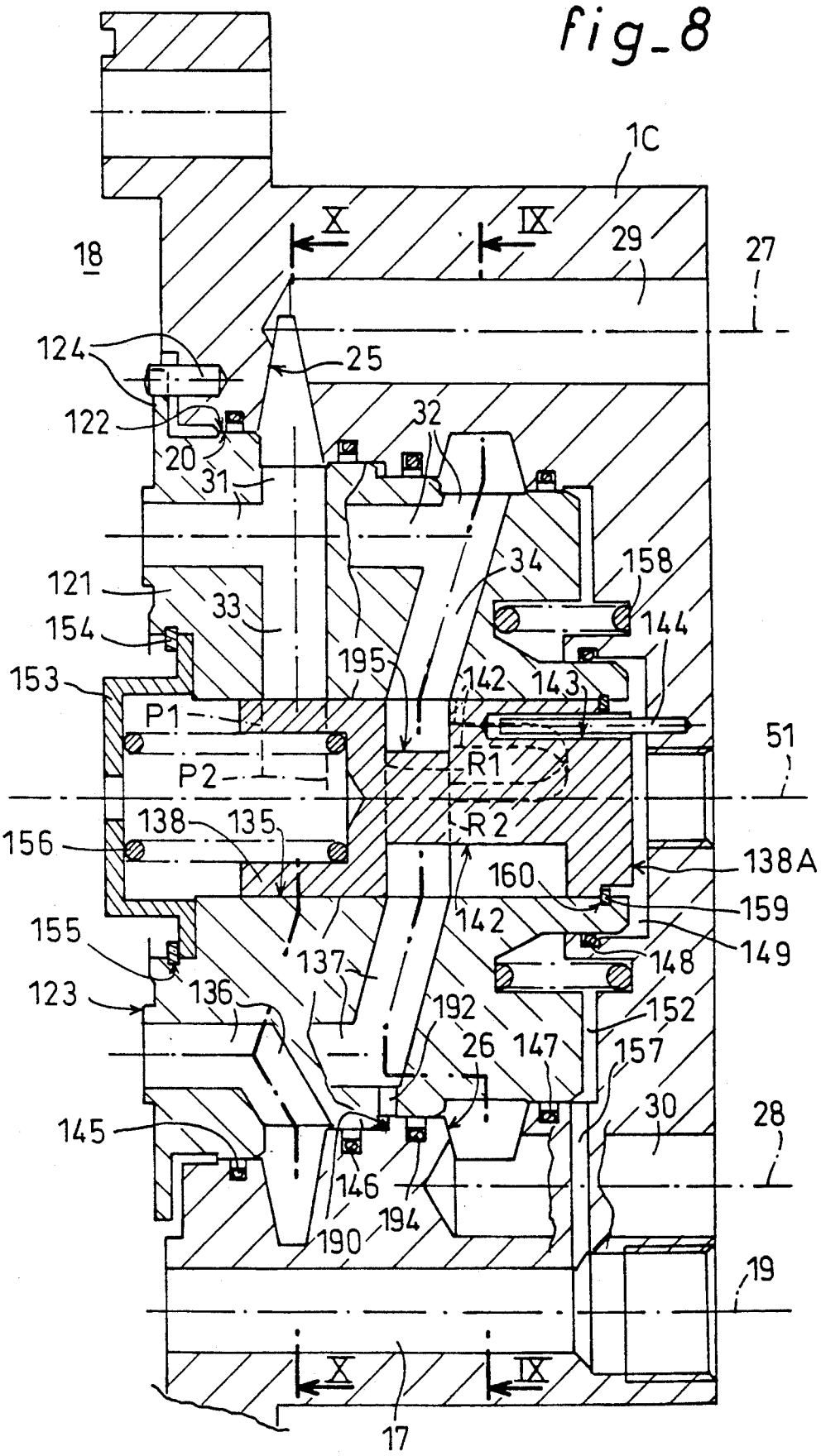
FIG. 8 is an axial section, similar to that of FIG. 2, of a hydraulic motor according to a second embodiment in accordance with the invention, shown in a first operational configuration.
Figure 9:
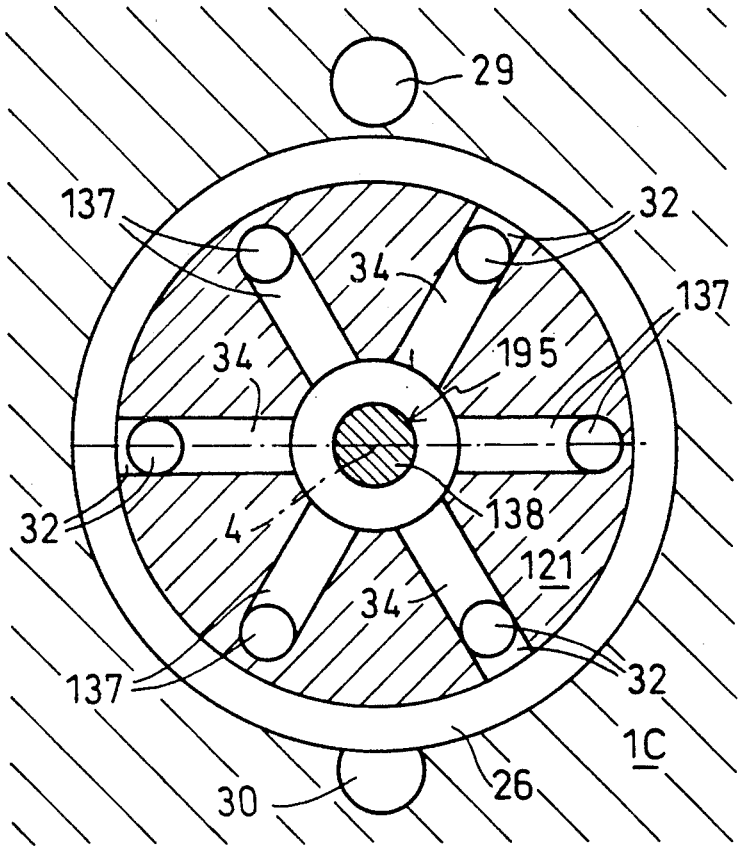
FIGS. 9 and 10 are sections respectively along IX—IX and X—X of FIG. 8.
Figure 10:
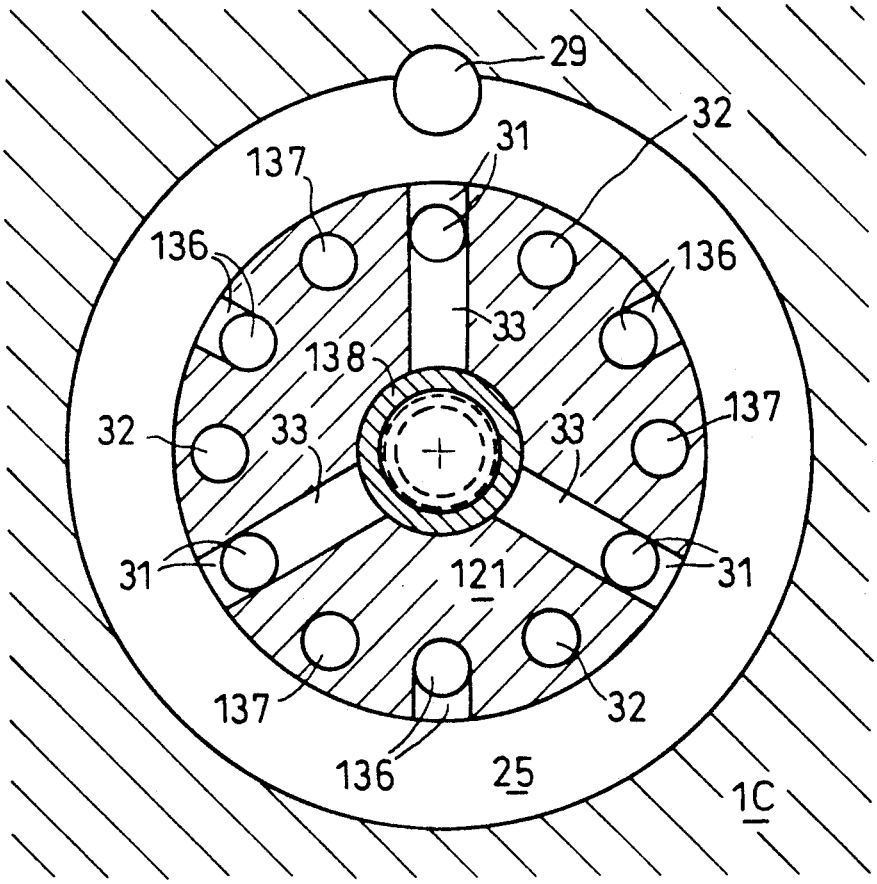
Figure 13:
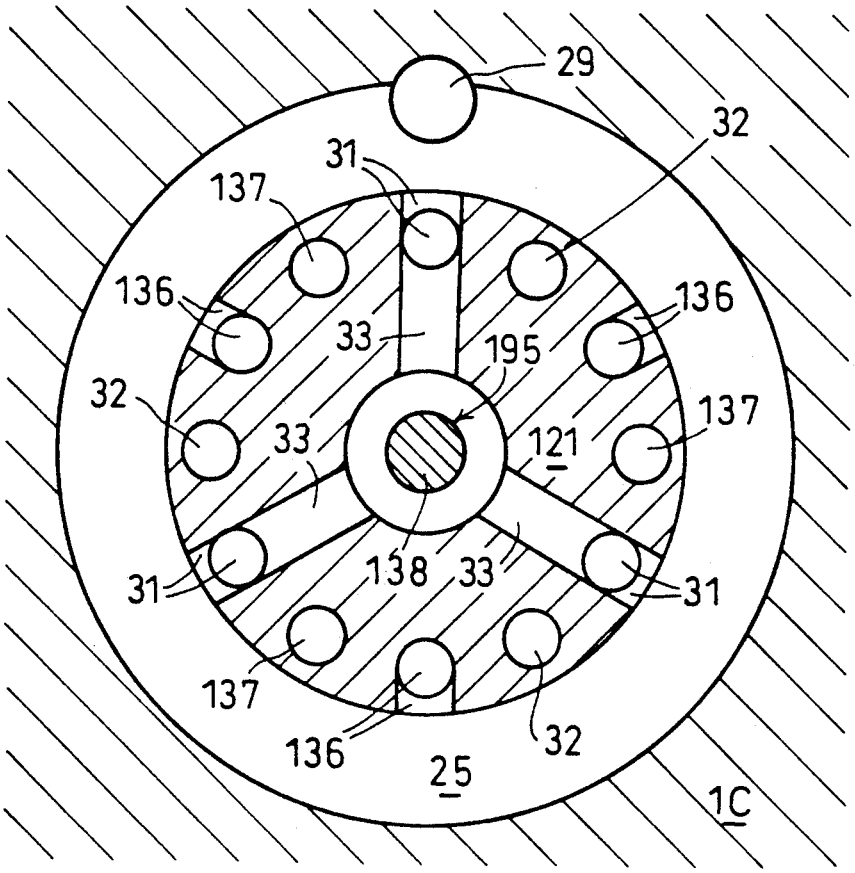

The principles of the so-called "asymmetrical" distributions are already known. It therefore suffices, as far as the functioning of the motor shown in FIGS. 8 to 13 is concerned, to briefly recall the functionings corresponding to the two configurations of the motor:

in the configuration of FIGS. 8 to 10, all distribution conduits 31 and 136 communicate with principal enclosure 25, whilst all distribution conduits 32 and 137 communicate with principal enclosure 26: the motor functions with its large cylinder capacity:

in the configuration of FIGS. 11 to 13, distribution conduits 31 and 137 are in mutual communication, and in communication with principal enclosure 25, as well as distribution conduits 136, with the result that, distribution conduits 136 and 137 communicating with the same principal enclosure 25, working chambers 12 communicating with said distribution conduits are defined by pistons producing no work: the motor functions with its small cylinder capacity.

It should be noted, for memory, that a motor such as the one shown in FIGS. 8 to 13 has, in principle, a preferential direction of rotation: the one for which distribution conduits 31 and principal enclosure 25 contain the fluid for exhaust of the fluid out of working chambers 12. In that case, distribution conduits 136 and 137 contain the same fluid, generally at low pressure. However, the motor also functions in the direction of rotation opposite said preferential direction.

The invention is not limited to the embodiments shown, but covers, on the contrary, all the variants which may be made thereto without departing from their scope nor spirit.

What is claimed is:

1. A pressurized fluid mechanism, such as a hydraulic motor or pump, with at least two distinct operational cylinder capacities, comprising:

a reaction cam;

a structure fast with said reaction cam and supporting it;

a cylinder-block mounted for relative rotation with respect to said structure about an axis of rotation and provided with a plane communication face perpendicular to the axis of rotation;

a plurality of cylinders arranged in said cylinder-block;

a plurality of pistons mounted to slide in said cylinders, at least one piston per cylinder defining inside said cylinder a fluid working chamber, which communicates with said communication face by a cylinder conduit;

an internal fluid distributor valve which is fast, with respect to rotation of said reaction cam, which defines between itself and said structure at least first and second principal fluid enclosures capable of containing, respectively, a fluid for supplying said working chamber and a fluid for exhaust of fluid from the working chambers, and which comprises a plane distribution face perpendicular to said axis of rotation, capable of being in substantially tight abutment on said communication face, distribution face into which open out pairs of distribution conduits made in the internal fluid distributor valve and distributed in at least two distinct groups of pairs of distribution conduits;

a device for selecting the cylinder capacity, which is constituted by a bore made in the internal fluid distributor and by a selection slide element mounted to move inside said bore, which is disposed on the distribution, conduits of at least a first of said two groups of pairs of distribution conduits, the mobile slide element comprising at least two positions, a first position in which first distribution conduits, one of each pair, of said two groups of pairs of distribution conduits are connected to a first of said principal enclosures, the second distribution conduits of said pairs of distribution conduits then being connected to the second of the two principal enclosures, and the second position in which the first distribution conduits and the second distribution conduits of said first group of pairs of distribution conduits are placed in mutual communication, the first distribution conduits of the second group of pairs of distribution conduits being connected to said first principal enclosure and the second distribution conduits of said second group of pairs of distribution conduits being connected to said second principal enclosure; wherein:

a1) at least one first and at least one second connection conduit, made in the internal fluid distributor valve, connect said first and second principal enclosures to said bore of the device for selecting the cylinder capacity and open out in this bore between planes belonging to a group of two first transverse planes and between planes belonging to a group of two second transverse planes, respectively;

b1) particular distribution conduits, constituted by distribution conduits belonging to the first group of pairs of distribution conduits, open out in said bore between two particular transverse planes belonging either to the group of said two first particular transverse planes, or to the group of said two second transverse planes;

c1) the mobile slide element of the device for selecting the cylinder capacity comprises at least one groove capable of being disposed at least partially between said two particular transverse planes; and d1) in the first position of the mobile slide element of the device for selecting the cylinder capacity, said groove is effectively contained at least partially between said two particular transverse planes and establishes communication between said particular distribution conduits and that of said first and second connection conduits which opens out between said two particular transverse planes, whilst, in its second position, said slide element obturates said connection conduit.

2. The pressurized fluid mechanism of claim 1, wherein:

b2) first and second particular distribution conduits are constituted by said first and by said second distribution conduits of the pairs of distribution conduits of the first group of pairs of distribution conduits and open out in said bore between the two first transverse planes and between the two second transverse planes, respectively;

c2) the mobile slide element of the device for selecting the cylinder capacity comprises a first and a second groove capable of being simultaneously disposed at least partially between said two first and between the two second transverse planes, respectively; and d2) in the first position of the mobile slide element of the device for selecting the cylinder capacity, said first and second grooves are effectively contained at least partially between said two first and between said two second transverse planes, respectively, and establish communications, on the one hand, between said first particular distribution conduits and said first connection conduit, on the other hand, between said second particular distribution conduits and said second connection conduit, respectively, whilst, in its second position, the slide element obturates said first and second connection conduits.

3. The pressurized fluid mechanism of claim 2, wherein the mobile slide element of the device for selecting the cylinder capacity is mounted to slide axially inside said bore, whilst being rendered fast with the internal fluid distributor valve with respect to a possible rotation about the axis of this bore, and comprises longitudinal communication grooves, which open out in one of said first and second grooves and which, in the second position of the mobile slide element, establish communication of said first and said second particular distribution conduits with said groove, and, by its intermediary, between said first and second particular distribution conduits themselves.

4. The pressurized fluid mechanism of claim 3, wherein the slide element of the device for selecting the cylinder capacity is coupled to a jack for adjusting its position which comprises a working chamber, whilst, in the second position of said slide element, a conduit, made in the internal fluid distributor valve, connects said groove, into which open out said longitudinal communication grooves, to said working chamber.

5. The pressurized fluid mechanism of claim 1, wherein:

b3) particular distribution conduits are constituted either by said first or by said second distribution conduits of the first group of pairs of distribution conduits and open out in said bore between two particular transverse planes belonging to one of said groups of two first transverse planes and of two second transverse planes, respectively;

c3) the mobile slide element of the device for selecting the cylinder capacity comprises a single groove capable of being disposed at least partially between said two particular transverse planes;

d3) in the first position of the mobile slide element of the device for selecting the cylinder capacity, said groove is effectively contained at least partially between said two particular transverse planes and establishes communication between said particular distribution conduits and the connection conduit which opens out between said two particular transverse planes, whilst, in its second position, the slide element obturates said connection conduit.

6. The pressurized fluid mechanism of claim 5, wherein, in the second position of the mobile slide element of the device for selecting the cylinder capacity, said single groove is contained at least partially between said two transverse planes other than said two particular transverse planes, whilst the mobile slide element is mounted to slide axially inside said bore, whilst being rendered fast with the internal fluid distributor valve with respect to a possible rotation about the axis of this bore, and comprises longitudinal communication grooves which open out in said single groove and which, in the second position of the mobile slide element, establishes communication of said particular distribution conduits with said groove and, by its intermediary, of said particular distribution conduits with that of said first and second connection conduits which opens out between said transverse planes other than said two particular transverse planes.

7. The pressurized fluid mechanism of claim 1, wherein at least one of said connection conduits is constituted by a conduit contained in the same radial plane as a distribution conduit of the second group of pairs of distribution conduits and constitutes an extension, up to the bore of the device for selecting the cylinder capacity, of a section of said distribution conduit.

8. The pressurized fluid mechanism of claim 2, wherein at least one of said connection conduits is constituted by a conduit contained in the same radial plane as a distribution conduit of the second group of pairs of distribution conduits and constitutes an extension, up to the bore of the device for selecting the cylinder capacity, of a section of said distribution conduit.

9. The pressurized fluid mechanism of claim 5, wherein at least one of said connection conduits is constituted by a conduit contained in the same radial plane as a distribution conduit of the second group of pairs of distribution conduits and constitutes an extension, up to the bore of the device for selecting the cylinder capacity, of a section of said distribution conduit.

10. The pressurized fluid mechanism of claim 1, wherein at least one of said connection conduits is constituted by a conduit contained in the same radial plane as a distribution conduit of the second group of pairs of distribution conduits and constitutes an extension, up to the bore of the device for selecting the cylinder capacity, of a section of said distribution conduit, whilst at least one distribution conduit belonging to the first group of distribution conduits, comprises a section which is disposed in a radial plane and which constitutes an extension, beyond said bore of the device for selecting the cylinder capacity, of said connection conduit.

11. The pressurized fluid mechanism of claim 2, wherein at least one of said connection conduits is constituted by a conduit contained in the same radial plane as a distribution conduit of the second group of pairs of distribution conduits and constitutes an extension, up to the bore of the device for selecting the cylinder capacity, of a section of said distribution conduit, whilst at least one distribution conduit belonging to the first group of distribution conduits, comprises a section which is disposed in a radial plane and which constitutes an extension, beyond said bore of the device for selecting the cylinder capacity, of said connection conduit.

* * * * *